United States Patent [19]

Zakis

[11] 3,994,042

[45] Nov. 30, 1976

[54] REMOVAL OF CUT HAIR BY VACUUM

[76] Inventor: Mary T. Zakis, 1785 Moor Dale Lane, Salt Lake City, Utah 84117

[22] Filed: Aug. 29, 1974

[21] Appl. No.: 501,568

[52] U.S. Cl. ..... 15/312 R; 15/314; 15/339; 132/9

[51] Int. Cl.[2] ..... B26B 19/44; A47L 5/38

[58] Field of Search ..... 15/301, 312 R, 312 A, 15/314, 315, 339, 393, 415; 132/9

[56] References Cited

UNITED STATES PATENTS

| | | | |
|---|---|---|---|
| 825,961 | 7/1906 | Deckert | 15/314 X |
| 1,560,347 | 11/1925 | Gambon | 15/339 X |
| 1,635,613 | 7/1927 | Ellerhorst | 15/301 X |
| 2,161,350 | 10/1939 | Hartzman | 132/9 |

*Primary Examiner*—Christopher K. Moore
*Attorney, Agent, or Firm*—Lynn G. Foster

[57] ABSTRACT

A vacuum unit for removal of hair as it is cut by barbers and beauticians, the vacuum unit being adapted to function in combination with a barber's or beautician's chair and comprises a source of vacuum power mounted to the base of the chair capable of being operated at the election of the operator, a flexible suction hose connected to the vacuum at one end and to a bracket mounted vacuum tube at the other end. A suction nozzle is pivotally mounted upon the vacuum tube and the vacuum tube and nozzle may be jointly translated along a track to any position immediately below the back side of the hair line of the person whose hair is being cut. Thus, the suction nozzle by swivel action in respect to the vacuum tube and by translation with the vacuum tube along the back of the patient to any location along the back between the ears of the customer accommodates during operation immediate pick up and disposition of cut hair in an economical, sanitary and highly efficient manner. A further embodiment comprises a suction adapter connecting at one end to the suction tube of the vacuum source and at the other to a slotted suction collar which concurrently serves the entire 180° area below the back hair line of the customer. The under side of the suction collar is appropriately secured to a flexible cape or covering for the customer.

6 Claims, 6 Drawing Figures

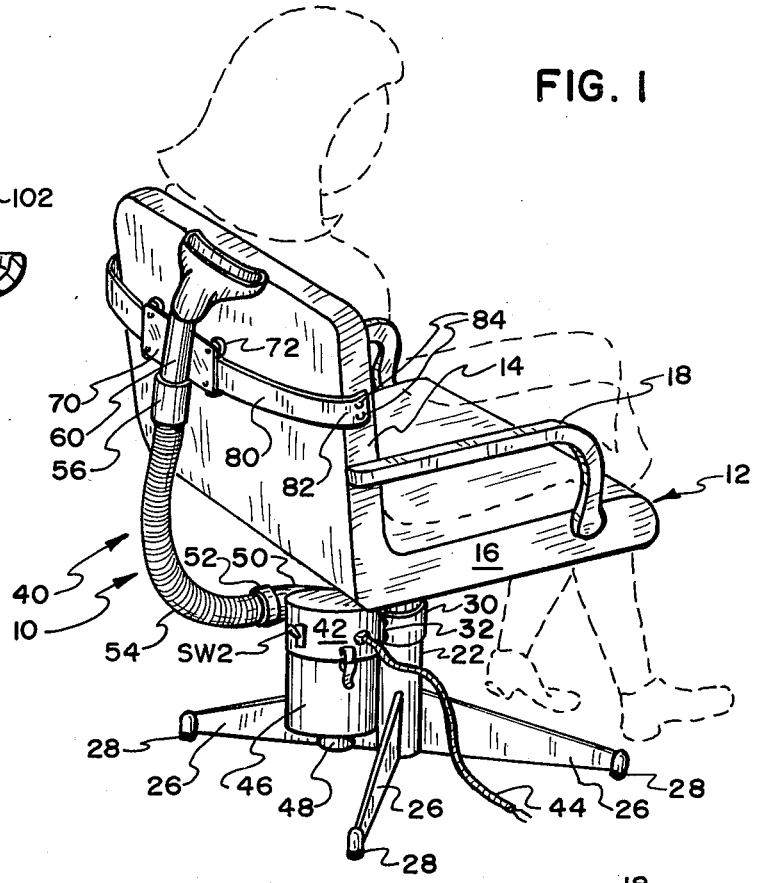
FIG. 2
FIG. 1
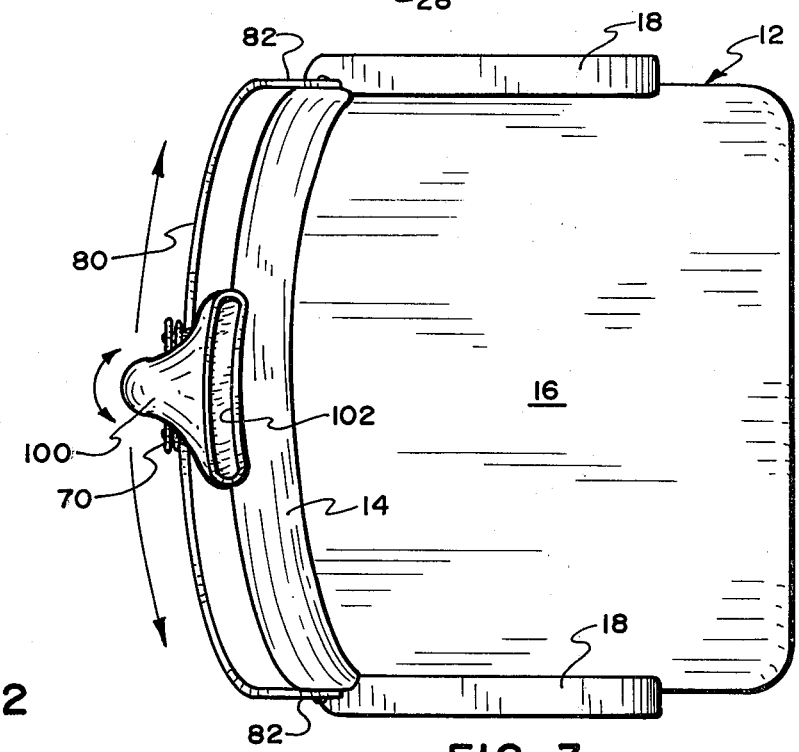
FIG. 3

REMOVAL OF CUT HAIR BY VACUUM

BACKGROUND

1. Field of Invention

The present invention relates generally to vacuum pick up devices and more particularly to a specialized vacuum mechanism used in conjuction with a beautician's or barber's chair adapted to be positioned by rotation and translation of the pick up head to any position to either side or to the rear of the patient covering essentially 180° below the hair line.

2. Prior Art

Previous proposals for removing hair cut from a customer by a barber or beautician have comprised various remote devices which require that the operator traverse a substantial distance to locate the operable end of a vacuum apparatus, place the operable end in the vicinity of the patient and proceed to rake or stroke areas where cut hair has accumulated. Attempts to locate a vacuum head adjacent the patient at one or more sites where hair may be removed as it is cut have proved to be cumbersome, bulky and have often interfered with the operator's normal work pattern. Apparatus of the type in question has heretofore been expensive, often difficult to maintain, inefficient and unsanitary. The purchase price has often been prohibitive. Clearly, a lack of convenience of use has greatly restricted utilization of such devices.

BRIEF SUMMARY AND OBJECTS OF THE PRESENT INVENTION

The present invention comprises an on-site vacuum mechanism the intake of which is disposed at the shoulder line and is capable of picking up hair as it is cut along essentially the 180° shoulder to shoulder distance at the back of a customer immediately below the hair line. The vacuum mechanism comprises a source, vacuum conduits connecting the source with a suction head which comprises an adapter or nozzle whereby the operation of the vacuum mechanism will withdraw cut hair into the vacuum receptacle instantaneously after being cut. In one presently preferred embodiment the vacuum head comprises a nozzle the transverse location of which may be readily adjusted along a track with little or no operator effort or inconvenience and which may also be facilely rotated so that the intake is positioned and may be repositioned to directly receive cut hair in the mentioned manner. A second embodiment comprises a slotted collar nozzle which is fixed in place and services the full 180° periphery about the shoulders below the hair line to the rear of the customer at all times during operation. It is preferred that the suction collar be integral with a cape or drape placed about the customer.

With the foregoing in mind, it is a primary object of the present invention to provide a novel vacuum unit in combination with a barber and beautician chair.

It is a further paramount object of the present invention to provide a novel vacuum mechanism used in conjunction with a chair of a beautician or barber which is disposed at or adjacent the shoulder line of a customer and which upon proper positioning will conveniently remove hair instantaneously upon being cut.

It is a further and also significant object of the present invention to provide a vacuum mechanism used in conjunction with a chair of a beautician or barber which requires very little or no maintenance, which is highly efficient and results in considerable saving of time to the operator, which improves sanitary conditions, which is economical to purchase, and which is conventiently installed and easily used.

These and other objects and features of the present invention will be apparent from the following detailed description, taken with reference to the accompanying drawings.

BRIEF DESCRIPTION OF THE DRAWINGS

FIG. 1 is a perspective representation of a chair equipped with a presently preferred vacuum mechanism embodiment in accordance with the present invention;

FIG. 2 is a fragmentary, enlarged cross-sectional view longitudinal of the nozzle, hose and track comprising part of the vacuum mechanism of FIG.1;

FIG. 3 is a plan view of the mentioned nozzle, hose and track;

DETAILED DESCRIPTION OF THE ILLUSTRATED EMBODIMENTS

Figure 4:
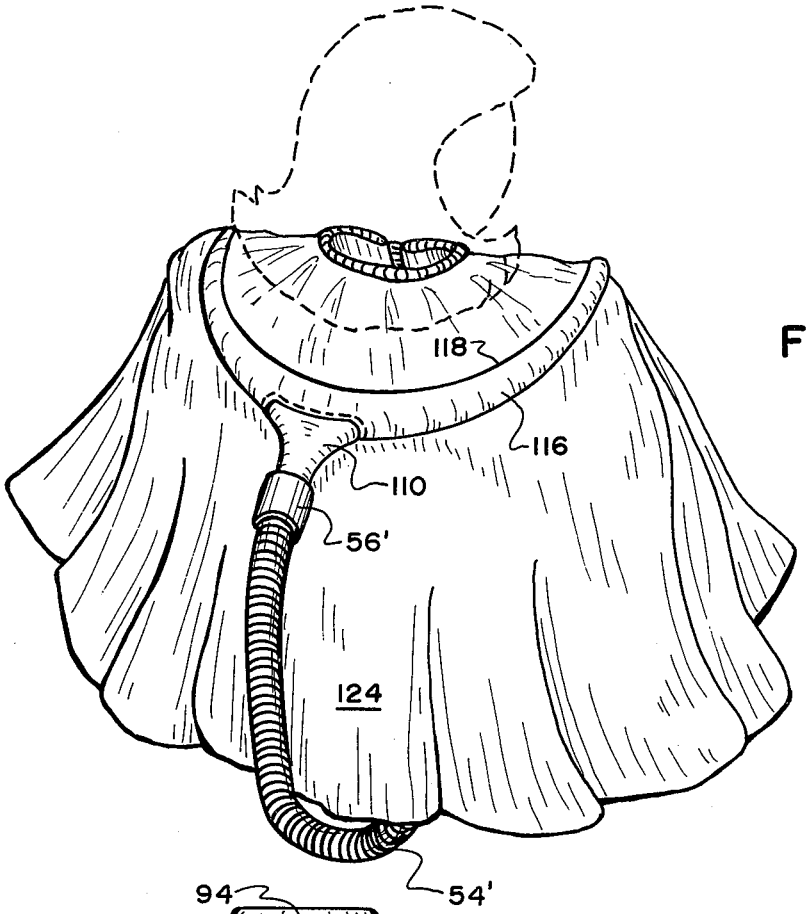
FIG. 4 is a perspective representation of a second presently preferred embodiment of the present invention.
Figure 6:
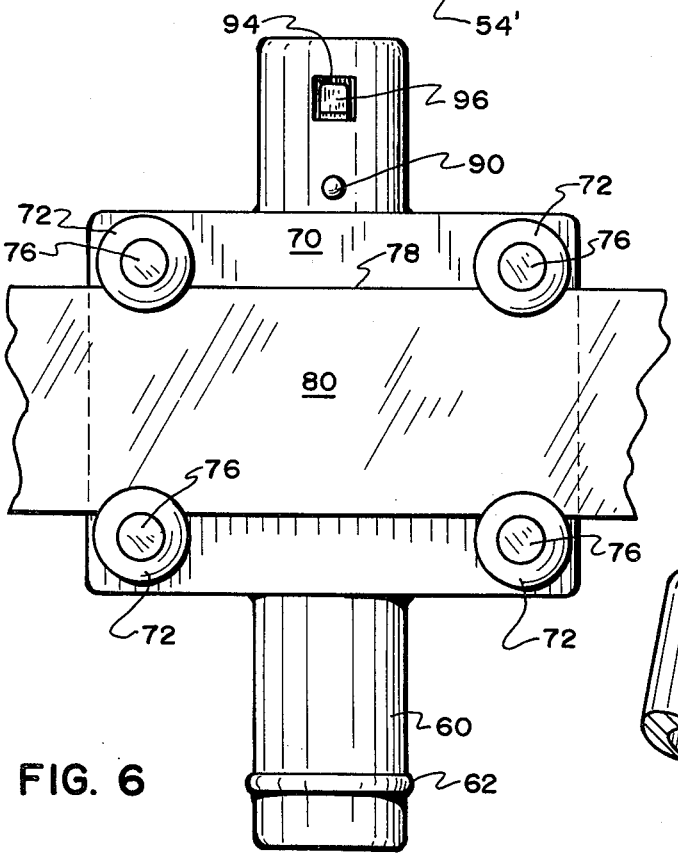
FIG. 6 is a fragmentary side elevation view of the track portion of the vacuum mechanism of FIG. 1.

Reference is now made to the drawings wherein like numerals are used to designate like parts throughout. FIGS. 1–3 illustrate one presently preferred embodiment of the present invention, generally designated 10. The embodiment 10 comprises a chair 12 which, for the most part, is conventional and comprises a back 14, a seat 16, spaced arm rests 18, and a base 20. Base 20 comprises a stand 22, a pedestal 24, which comprises radial legs 26, each of which carry a ground engaging foot 28. A vacuum clamp 30 snugly circumscribes the 360° cross-sectional periphery of the stand 22 and comprises an eccentric planar flange 32, which has apertures adapted to receive bolts in the manner and for purposes hereinafter more fully explained. Naturally, as would be readily apparent to one of ordinary skill in the art, the chair 12 may comprise means for elevating and lowering the seat 16 to accommodate proper positioning of the customer for the cutting of hair by a barber, beautician or the like. By the same token, the seat 16 may swivel in respect to its base, also in a conventional manner using well known component parts.

The unit 10 comprises a vacuum mechanism 40 including a vacuum source 42 of conventional design mounted to the flange 32 and including a motor and blower controlled by an off/on switch SW2, electrical power being supplied to the vacuum source via cord 44. The vacuum 42, as is conventional, comprises a canister 46 from which air is discharged at exhaust port 48. The vacuum 42 also comprises a suction intake port 50, to which an elbow 52 is rotatably attached. The elbow 52 is hollow and communicates with the interior of a plastic flexible hose 54, which extends essentially vertically from the vacuum 42 to near the top of the chair back 14. The plastic flexible hose 54 terminates in a snap-on female fitting 56, into which a downwardly extending male end 58 of a rigid vacuum tube 60 extends and is there retained by engagement of a radially enlarged portion 62 within an annular groove 64 of the coupling 56. Thus, the vacuum tube 60 projects in a vertically erect fashion. A roller bracket 70 is welded or otherwise suitably secured to the vacuum tube 60 and circumscribes, in the illustrated embodiment essentially 180° thereof. The bracket 70 provides a mounting base for an upper air and a lower air of nylon rollers 72, each of which defines a u-shaped annular guide 74 and is journaled upon studs 76 which in turn are anchored to the bracket 70. The U-shaped annular cavity 74, as best illustrated in FIG. 2, engages and rolls along the top and bottom edges 78 of a track rail 80, which is in the nature of a plate bent into a U configuration as best illustrated in FIG. 3. The turned ends 82 of the rail 80 are fastened by countersunk screws 84 or the like to the interior frame of the chair back 14 so that the rail 80 is held rigidly in the illutrated position accommodating complete transverse translation of the vacuum tube 60 from one side of the chair to the other and allowing for the vacuum tube 60 to be positioned at any location between thhe anchored ends 82.

A rivet 90 secures one end of a spring retainer 92 to the interior of the tube 60 above and immediately adjacent the rollers 72, the tube 60 being provided with an aperture 94 through which a shoulder 96 at the other end of the spring retainer 92 passes. The aperture 94 is confined to an opening just large enough to accommodate the shoulder 96, with the shoulder 96 becoming disposed within an annular recess 98 of a suction nozzle 100 whereby the nozzle 100 is prohibited from axial displacement in respect to the vacuum tube 60 but is allowed to rotate or swivel 360° in respect thereto. The intake opening 102 of the nozzle 100 may be of any desired configuration to cause hair cut from the customer to be received and ultimately displaced to a filter bag or the like contained within the canister 46 of the vacuum 42. It should be readily apparent from the description of the embodiment of FIGS. 1–3 that the apparatus may be readily used by displacement of the nozzle 100 along the track 80 and by rotation of the nozzle 100 in respect to the vacuum tube 60 such that the nozzle becomes situated directly below the hair being cut, in a convenient and non-troublesome manner. The mechanism is easily constructed, readily maintained and economical.

Figure 5:
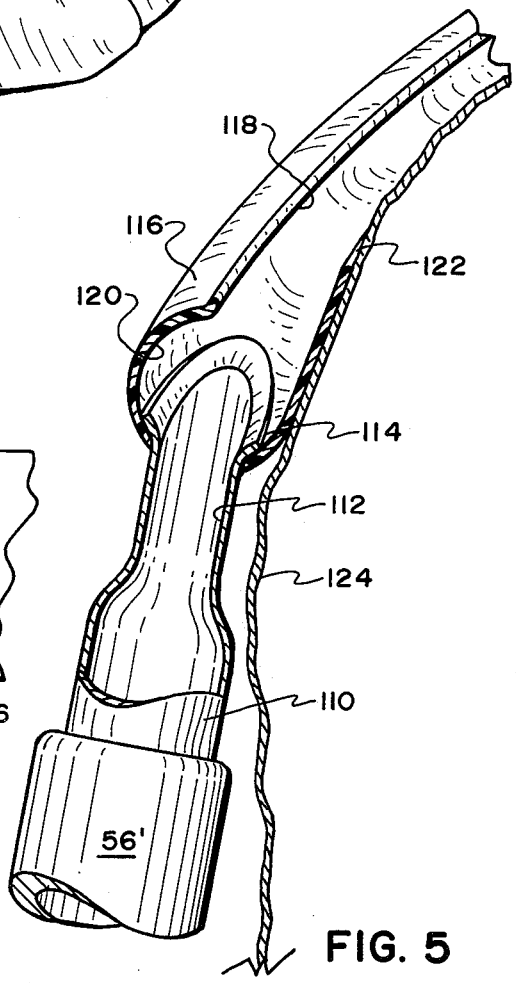
FIG. 5 is a fragmentary perspective of the split suction collar of the cape embodiment of FIG. 4 with parts broken away for purposes of clarity.

Reference is now made to FIGS. 4 and 5 which illustrate a second presently preferred embodiment in accordance with the present invention. The embodiment of FIGS. 4 and 5 may comprise, though not illustrated in the drawings for sake of brevity, a suitable chair of the type previously herein explained for receiving a customer and a suitable vacuum source, such as the one heretofore described, to which the plastic flexible hose 54' connects. The hose 54' is connected by coupling 56' just as hose 54 connects to coupling 56, with an adapter 110 being press fit into the coupling 56'. The adapter 110 has a hollow interior which defines a constriction 112 (FIG. 5) but otherwise divergently increases in size in the direction away from the coupling 56'. The leading end 114 of the adapter 110 is flaired and bonded to a suction collar 116. Collar 116 traverses essentially 180° from shoulder to shoulder below the hair line and along the back of the customer and comprises a hair receiving slot 118 such that hair cut from the customer at any location to either side or behind the patient will normally fall into a position adjacent the slot 118 and be drawn by vacuum pressure into the interior cavity 120 of the suction nozzle 116 and from thence through the adapter 110, the coupling 56', the flexible hose 54' to a filter bag or the like within the vacuum. Preferably, the under side of the suction collar 116 at or near the lower lip 122 is bonded or otherwise suitably secured to a plastic or like cape 124 which is placed around the neck of the customer and hangs down over a substantial part of the customer's body.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A dynamic system for removing hair as it is cut comprising:

a chair having a seat and a back in which a person whose hair is to be cut is seated;

a vacuum source carried by the chair;

track means functioning to define a route along which track-following means are displaced, said track means being mounted to the back of the chair spaced a short distance from and rigidly extending generally transversely parallel to the top portion of the back of the chair;

dynamic track-following means functioning to carry vacuum nozzle means back and forth along the track means, the track-following means being displacably carried by the track means for lateral reciprocal translation back and forth along the track means while the hair of the occupant of the chair is being cut;

vacuum pathway means spanning and functioning to channel air flow between the vacuum source and the trackfollowing means, one end of the vacuum pathway means being attached to and laterally translatable with the track-following means during said hair cutting phenomenon;

vacuum nozzle means attached to said one end of the vacuum pathway means and functioning to accommodate air intake, the vacuum nozzle means comprising air intake opening means being rotatably connected to said pathway means and extending upward to an elevation above the back of the chair, the intake opening means therby being facilely and dynamically transversely translated along the track means and rotated in respect to the pathway means during said hair cutting phenomenon for immediate disposition directly below essentially any hair cutting site at the sides or back of the head of the person.

2. A system according to claim 1 wherein said vacuum source is fastened to the base of the chair.

3. A system as defined in claim 1 wherein said track means comprises a plate rail.

4. A system for removing hair as it is cut comprising:

a chair having a seat and a back in which a person whose hair is to be cut is seated;

a vacuum source carried by the chair;

track means functioning to define a route along which track-following means are displaced, said track means comprising a plate rail fixed to the chair back below the top thereof and spaced a short distance from and extending generally transversely parallel to the top portion of the back of the chair;

track-following means functioning to carry vacuum nozzle means back and forth along the track means, the track-following means comprising a plurality of track engaging rollers and a bracket to which the rollers are rotatably connected, the track-following means being mounted to the track means for reciprocal movement back and forth along the track means;

vacuum pathway means spanning and functioning to channel air flow between the vacuum source and the trackfollowing means, one end of the vacuum pathway means being attached to and movable with the track-following means;

vacuum nozzle means functioning to accommodate air intake and comprising intake opening means being rotatably connected to said pathway means and extending upward to an elevation above the back of the chair;

whereby the intake opening means may be facilely translated along the rack and rotated in respect to the pathway means for immediate disposition directly below essentially any hair cutting site at the sides or back of the head of the person.

5. The system as defined in claim 1 wherein said vacuum pathway means comprises a flexible hose and at least one rigid coupling member disposed at one end of the hose.

6. The system as defined in claim 1 wherein the pivot connection between the vacuum nozzle means and the pathway means comprises a spring resiliently carried by the pathway means, a shoulder of the spring projecting through an aperture in the pathway means and coming to rest upon an annular groove along the inside of the vacuum nozzle means whereby 360° rotation of the vacuum nozzle means in respect to the pathway means is accommodated.

* * * * *